US006062495A

United States Patent [19]

Ushioda et al.

[11] Patent Number: 6,062,495

[45] Date of Patent: May 16, 2000

[54] HIGH PRESSURE RAPID CUTTING TIP NOZZLE

[75] Inventors: Bunnosuke Ushioda, Atami; Tamiya Yoshino, Kitakyushu, both of Japan

[73] Assignee: Nippon Speng Co., Ltd., Tokyo, Japan

[21] Appl. No.: 09/210,162

[22] Filed: Dec. 11, 1998

[30] Foreign Application Priority Data

Dec. 26, 1997 [JP] Japan ..... 9-361519

[51] Int. Cl.[7] ..... B05B 7/06

[52] U.S. Cl. ..... 239/424.5; 239/428; 239/558; 239/560

[58] Field of Search ..... 239/423, 424.5, 239/424, 428, 558, 549, 560

[56] References Cited

U.S. PATENT DOCUMENTS

| | | | |
|---|---|---|---|
| 1,287,437 | 12/1918 | Reynolds | 239/424.5 |
| 1,971,287 | 8/1934 | Walker | 239/424.5 X |
| 2,520,001 | 8/1950 | Eicher | 239/424.5 X |
| 2,655,206 | 10/1953 | Eichelman | 239/424 X |

FOREIGN PATENT DOCUMENTS 539293 10/1993 Japan .

*Primary Examiner*—Kevin Weldon
*Attorney, Agent, or Firm*—Hayes, Soloway, Hennessey, Grossman & Hage, P.C.

[57] ABSTRACT

The present invention relates to a high pressure, rapid cutting tip nozzle which provides a cutting oxygen jet hole 2*b* in the front end surface, and provides concentrically from the inside, with this cutting oxygen jet hole 2*b* as the center, a first oxygen jet hole group 7*a*, a first fuel gas jet hole group 8*c*, a second fuel gas jet hole group 8*a*, and an oxygen jet opening 9*a*, and wherein steel is cut by the high pressure gas flow jetting from the cutting oxygen jet hole 2*b*, and in particular is characterized in the front end of flow paths 9*b* and 9*c*, which branch from the flow path 9 leading to the oxygen jet opening 9*a*, opening on the side surface of flow paths 8 and 8*b*, which lead to the first and second fuel gas jet hole group 8*c* and 8*a*, at a point within 10 mm from said front end surface. According to the present invention, gas cutting of steel can be carried out with high efficiency and safely.

7 Claims, 4 Drawing Sheets

HIGH PRESSURE RAPID CUTTING TIP NOZZLE

BACKGROUND OF THE INVENTION

1. Field of the Invention

The present invention relates to a high pressure rapid cutting tip nozzle suitable for use in gas cutting a thick steel plate, such as in continuous strands gas cutting machines. This application is based on patent application No. Hei 9-361519 filed in Japan, the content of which is incorporated herein by reference.

2. Description of the Related Art

Previously, the present inventors proposed a high pressure rapid cutting tip nozzle (referred to hereinbelow as a "tip nozzle") disclosed in Japanese Utility Model, No. Hei 5-39293. This tip nozzle provides, from the inside around the cutting oxygen jet hole positioned at the center, a first oxygen jet hole group, a first fuel gas jet hole group, a second fuel gas jet hole group, and a second oxygen jet hole group or an oxygen jet opening, so as to form concentric circles centered on the cutting oxygen jet holes. In addition, in order to increase the heating effect, between adjacent fuel gas jet holes, oxygen jet holes which branch from the flow path leading to the oxygen jet holes are provided.

When cutting steel, the high pressure cutting oxygen jet flow from the cutting oxygen jet hole jets out at a high speed, and a first heating flame group is formed from the jetting oxygen and the fuel gas which jets out so as to surround it. In addition, a second heating flame group is formed around the first heating flame group. Additionally, from the multiplicative effect of these heating flame groups, in particular the first heating flame group which covers the cutting oxygen jet flow, is extended and maintained. As a result, the jet effect of the cutting oxygen jet flow jetting from the cutting oxygen holes is increased, and highly efficient gas cutting can by carried out even on thick steel.

However, the tip nozzle of Japanese Utility Model, No. Hei 5-39293 mixes the fuel gas and oxygen at the nozzle end, using a mixing system called out mixing (also called post mixing). Because the fuel gas and oxygen are mixed outside the tip nozzle, the mixing rate of this system is rather low compared to torch mixing, carried out in the blow pipe on which the tip nozzle is installed, and tip mixing, carried out in the tip nozzle, and therefore, there is a tendency for the burn efficiency to deteriorate.

However, the flame of the gas from igniting the mixed gas used in a gas cutter has a temperature exceeding 3000° C., and jets very rapidly. Because of this, if the flow is blocked due to cutting slag, etc., during cutting, the flame runs up the tip nozzle and the blow tube, and there is the problem of causing what is called a back fire or a flash back. Thus, taking this into account, particularly in gas cutting thick steel which consumes fuel gas or oxygen in a high volume, out mixing is generally used.

In consideration of the above, it is the object of the present invention to mix fuel gas and oxygen satisfactorily and improve the cutting efficiency while paying attention to safety in a tip nozzle of an out mixing system.

SUMMARY OF THE INVENTION

The present invention is a high pressure rapid cutting tip nozzle, wherein a cutting oxygen jet hole opens on the end, and with the cutting oxygen jet hole at the center, is provided concentrically from the inside with a first oxygen jet hole group, a first fuel gas jet hole group, a second fuel gas jet hole group, and an oxygen jet opening, and by the high pressure gas flow jetting from this cutting oxygen jet hole, steel is cut. The front end of the flow path, which branches from the flow path leading to said oxygen jet opening and extends to the front end side, has openings on the side surface of the flow path leading to these first and second fuel gas jet holes at a point within 10 mm from said end surface.

This oxygen jet opening can also be a second oxygen jet hole group disposed concentrically around the cutting oxygen jet hole.

In addition, between the first oxygen jet hole group and the second fuel gas jet hole group, the first fuel gas jet hole group can be disposed as a whole alternating with the oxygen jet hole group, centered on the cutting oxygen jet hole group.

Furthermore, by cutting off the front end of the tubular body which partitions the second fuel gas jet hole group and the oxygen jet opening at a point within 10 mm from the end surface, the flow path branching from the flow path leading to the oxygen jet opening, and leading to the second fuel gas holes can be eliminated.

Additionally, the second fuel gas jet hole group and the oxygen jet hole group can be eliminated, and the fuel gas jet hole group merged.

DESCRIPTION OF PREFERRED EMBODIMENTS

Below, the embodiments of the present invention will be explained referring to the figures.

Figure 1:
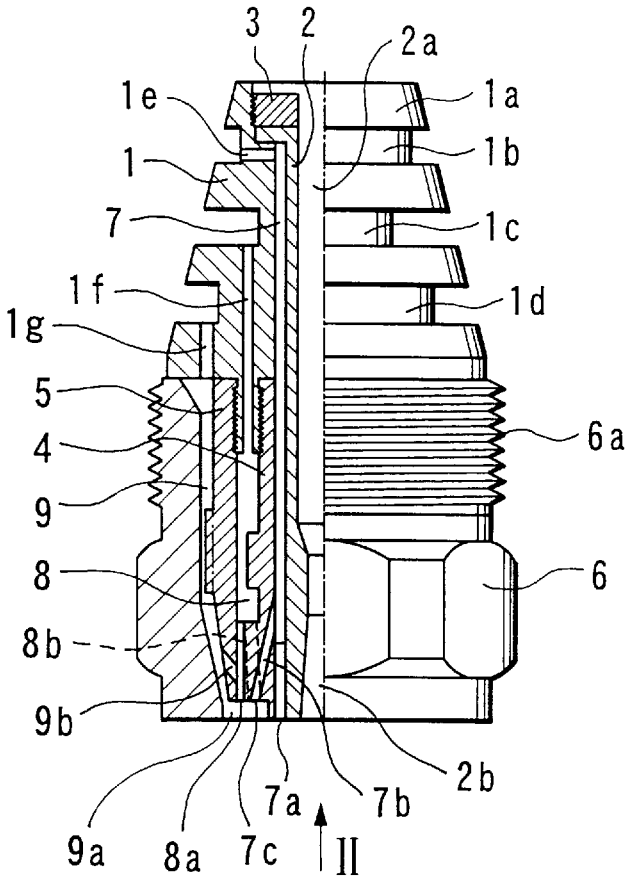
FIG. 1 shows a first embodiment of the present invention, and is a partial cut-away along line I—I in FIG. 2 of the tip nozzle.
Figure 2:
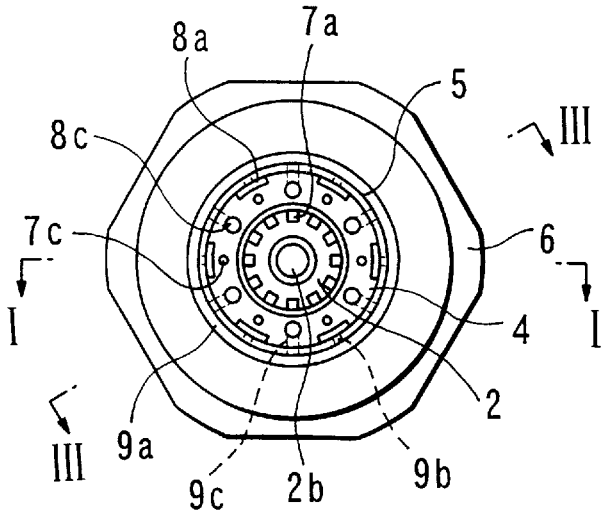
FIG. 2 shows a first embodiment of the present invention, and is a front view along the arrow I—I in FIG. 1 of the tip nozzle.
Figure 3:
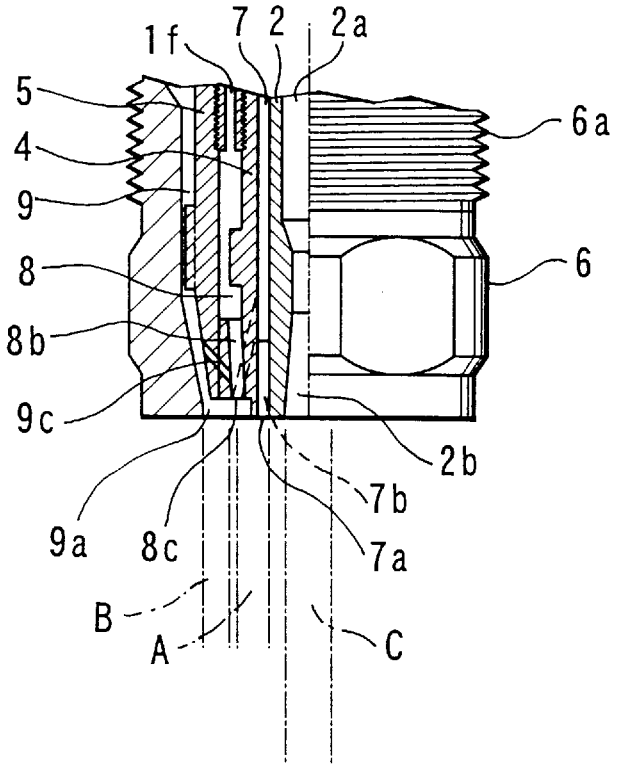
FIG. 3 shows a first embodiment of the present invention, and is a partial cut-away along line III—III in FIG. 2 of the tip nozzle.

FIG. 1 through FIG. 3 show the first embodiment of the present invention. The base end (upper end in FIG. 1) of the tip nozzle body 1 which forms a tube has a tapered surface 1*a*communicating with the blow tube (not shown) for the oxygen and fuel gas supply. On the tapered surface 1*a*,concavities 1*b*, 1*c*, and 1*d*, which respectively receive oxygen, fuel gas, and oxygen supplied from the blow pipe, are formed, and from concavity 1*b*, the flow path 1*e*towards the inside of the tip nozzle is formed. In addition, from concavities 1*c* and 1*d*, a plurality of flow paths 1*f*, 1*g* extending to the front end of the tip nozzle 1 are formed concentrically so as to be coaxial with the tip nozzle 1.

In the tip nozzle body 1, a tubular sleeve 2 is inserted from the base end, and is held by a nut 3. In the center of the sleeve 2, a flow path 2*a* for cutting gas oxygen supply is formed so as to be coaxial with sleeve 2. In addition, the front end of the flow path is a cutting oxygen jet hole 2*b* which widens towards the end.

The periphery of the sleeve 2 is covered by the tubular body 4 installed on the front end of the tip nozzle body 1. The tubular body 4 is curricular, and its periphery is covered by a circular tubular body 5 installed on the front end of the tip nozzle body 1 in the same manner. The periphery of the tubular body 5 is covered by a cover 6, and on the base end outer peripheral surface of the cover 6, a screw 6*a* for mounting the tip nozzle to the blow pipe is formed. In addition, in the tip nozzle of the present invention, lie the tip nozzle disclosed in Japanese Utility Model, No. Hei 5-39293, at the time of the mounting of the blow pipe, the tapered surface 1*a* is securely attached to the plow pipe, and between the side wall of the tubular body 5 and the cover 6, a small gap is formed.

Along with the installation of the tubular body 4, between the sleeve 2 and the tubular body 4, a flow path 7 for oxygen supply is formed. The base end of the flow path 7 communicates with the flow path 1*e*, and the front end of the flow path 7 forms the first oxygen jet hole group 7*a* disposed surrounding the tip nozzle body 1. In addition, between the tubular bodies 4 and 5, a flow path 8 for fuel gas supply is formed. The base end flow path 8 communicates with the flow path 1*f*, and the front end of the flow path 8 forms the second fuel jet hole group 8*a* disposed circumferentially on the tip nozzle body 1 radially outside of the first oxygen jet hole group 7*a* Furthermore, between the tubular body 5 and the cover 6, a flow path 9 for oxygen supply is formed. The base end of the flow path 9 communicates with the flow path 1*g*, and the front end of the flow path 9 forms the circular oxygen jet opening 9*a* circumferentially on the tip nozzle body 1 radially outside of the second fuel gas jet hole group 8*a*.

Reference numbers 7*b* and 8*b* are the flow paths in the tubular body 4 which branch from the flow paths 7 and 8 and extend at an angle towards the respective front end sides. The front ends of these flow paths 7*b* and 8*b* on the front end surface of the tubular body 4 open alternately in a circle on a tubular body 4 between the first oxygen jet hole group 7*a* and the second fuel gas jet hole group 8a As a result, between the first oxygen jet hole group 7*a* and the second fuel gas jet hole group 8*a*, the oxygen jet hole group 7*c* and the first fuel gas jet hole group 8*c* for improving heating and burning are alternately disposed so as to be concentric with the tip nozzle body 1 as a whole.

In addition, on the tip nozzle of the present embodiment, the front end of flow paths 9*b* and 9*c*, which branch from flow path 9 and extend at an angle to the front end, respectively open on the side surface of flow path 8 leading to the second fuel gas jet hole group 8*a* and the side surface of the flow path 8*b* leading to the first fuel gas jet hole group 8*c* at a point within 10 mm from the front end surface of the tip nozzle. Finally, the tip nozzle is formed by the structure from this tip nozzle body 1 to the flow path 9*c*.

When cutting steel, first the tip nozzle is mounted on a blow pipe, the valve of the blow pipe is opened, the fuel gas is supplied to flow path 1*f*, and the combusting gas jets from the first fuel gas jet hole group 8*c* and the second fuel gas jet hole group 8*a* via the flow path if and flow paths 8 and 8*b*. In addition, at about the same time, the flow paths 1*e* and 1*g* are supplied with oxygen, and the oxygen jets from the first oxygen jet hole group 7*a*, the oxygen jet hole group 7*c*, and the oxygen jet opening 9*a* via the flow paths 1*e*, 1*g*, 7, 7*b*, and 9.

Furthermore, in the tip nozzle of the present embodiment, one part of the oxygen supplied to the flow path 9, is supplied to flow paths 8 and 8*b* at a point within 10 mm from the front end surface of the tip nozzle via flow paths 9*b* and 9*c*. As a result, the mixed gas of the fuel and oxygen jets from the first fuel gas jet hole group 8*c* and the second fuel gas jet hole group 8*a*.

Additionally, in this state, after the tip nozzle is ignited and the steel to be cut is heated, or at the same time as the above-described supplying of the fuel gas and the oxygen, oxygen is supplied to the flow path 2*a*, and high pressure oxygen jets from the cutting oxygen jet hole 2*b*. Thereby, as shown in FIG. 3, by the oxygen jetting from the cutting oxygen jet hole 2*b*, a very high speed cutting oxygen jet flow (reference letter C in FIG. 3) is formed. In addition, surrounding the cutting oxygen jet flow C, the first heating flame group (reference letter A in FIG. 3) is formed from the oxygen and fuel gas, and surrounding this, the second heating flame group (reference letter B in FIG. 3) is formed. Because the first heating flame group A multiplicatively extends the second heating flame group B, attenuation of the kinetic energy in the cutting oxygen jet flow C can be restrained. As a result, the jet effect of the cutting oxygen jet flow C is increased, and the gas cutting by the cutting oxygen jet flow C is very efficient even for thick steel.

Furthermore, in the tip nozzle of the present invention, oxygen is supplied in advance from the flow paths 9*b* and 9*c* to the fuel gas flow paths 8 and 8*b*. As a result, a mixed gas of agitated fuel gas and oxygen jets from the first fuel jet hole group 8*c* and the second fuel gas jet hole group 8*a*, and further, in this mixed gas, at the front end of the tip nozzle, inner side, outer side, and heating oxygen merge and mix, and the first heating flame group A and the second heating flame group B form.

Therefore, in comparison with conventional tip nozzles which mix the fuel gas and oxygen at the front end of the tip nozzle, the mixture ratio of the fuel gas and oxygen in the heating flame groups A and B is improved greatly. As a result, the flame becomes strong and well elongated, and the gas cutting of a thick steel plate becomes more efficient. For example, in a cutting test of a steel plate using the tip nozzle of the present invention, in comparison with conventional tip nozzles, the preheating time for the cutting start time is reduced 20~30%, and the cutting speed is increased 5~15%.

In addition, because the fuel gas and the oxygen mix at a point within 10 mm from the front end surface of the tip nozzle, that is, extremely close to the front end of the tip nozzle, back fire and flash back are not produced, and the safety during cutting is ensured.

Figure 4:
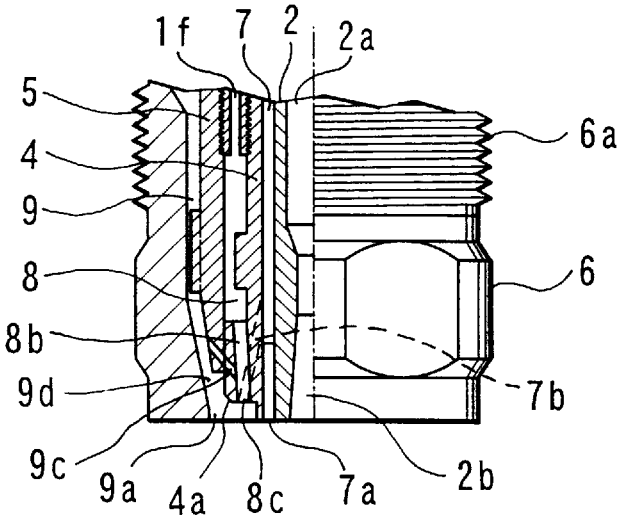
FIG. 4 shows a second embodiment of the present invention, and is a partial cut-away of the tip nozzle when the tip nozzle is cut in the same manner as in FIG. 3.

FIG. 4 is a second embodiment of the present invention, and shows the tip nozzle cut in the same manner as that in FIG. 3. In this tip nozzle, the front end of the tubular body 5 is cut off at a point within 10 mm from the front end surface of the tip nozzle, the length of the tubular body 5 is shortened, and thereby the passage of the fuel gas is exposed at the bottom, and the inconvenience of providing a flow path 9*b* for oxygen is eliminated. As a result, in this tip nozzle, the fuel gas and the oxygen are mixed in one part of the passage 9*d* formed on the front end side of the tubular body 5. In addition, the front end 4*a* of the tubular body 4 inclines along the direction of the flow of the oxygen.

In this tip nozzle as well, on the flow path 8*b* up to the first fuel gas jetting hole group 8*c*, the flow path 9*c*, which branches from the flow path 9 up to the oxygen jetting hole 9*a*, merges at a point within 10 mm from the front end surface of the tip nozzle, and a higher flame efficiency can be achieved. That is, the operational effect is the same as the first embodiment.

Figure 5:
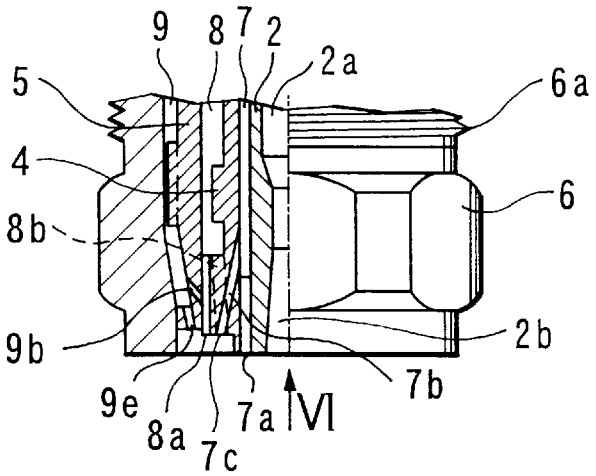
Fig. 5 shows a third embodiment of the present invention, and is a partial cut-away along line V—V in FIG. 6 of the tip nozzle.
Figure 6:
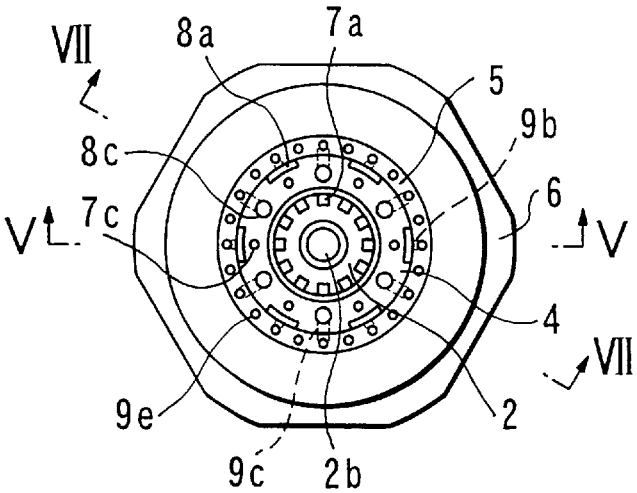
FIG. 6 shows a third embodiment of the present invention, and is a front view along the arrow VI in FIG. 5 of the tip nozzle.
Figure 7:
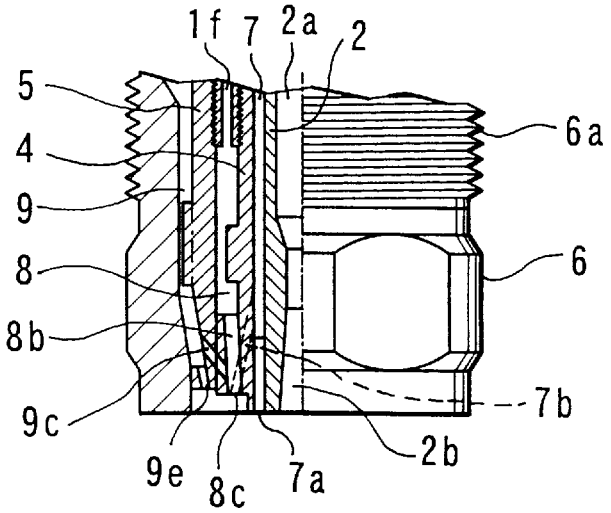
FIG. 7 shows a third embodiment of the present invention, and is a partial cut-away along line VII—VII in FIG. 6 of the tip nozzle.

Fig. 5 to FIG. 7 show the third embodiment of the present invention. In this tip nozzle, the front end of the tubular body 5 expands in the outward radial direction (where a slight gap is provided on the outer circumference in contact with the cover 6), and like that shown by reference number 9*a* in FIG. 1, the shape of the oxygen jetting opening is circular, as shown by reference number 9*e*, as a whole, has been altered to a plurality of holes (second oxygen jetting hole group) in the form of a circle centered on the tip nozzle 1.

Figure 8:
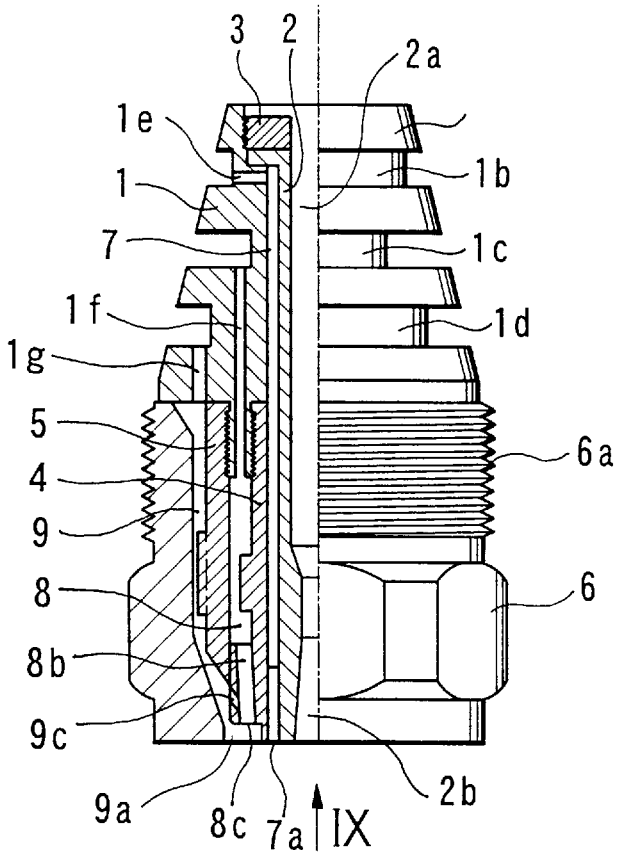
FIG. 8 shows a fourth embodiment of the present invention, and is a partial cut-away along line VIII—VIII in FIG. 9 of the tip nozzle.
Figure 9:
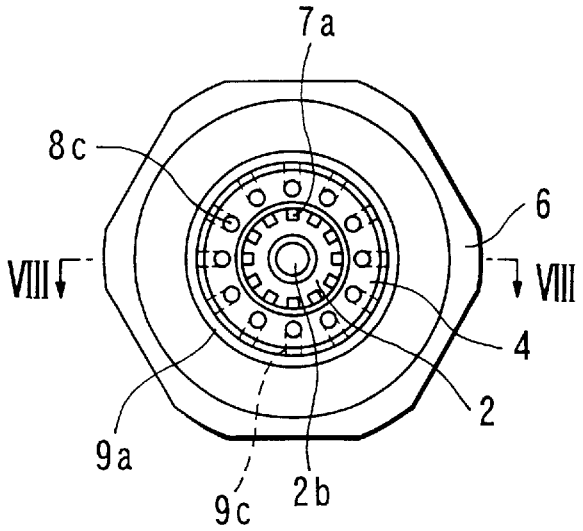
FIG. 9 shows a fourth embodiment of the present invention, and is a frontal view along the arrow IX in FIG. 8 of the tip nozzle.

FIG. 8 to FIG. 9 show the fourth embodiment of the present invention. In this tip nozzle, the oxygen jetting hole group 7*c* and the second fuel gas jetting hole group 8*a* are eliminated, and the front end of the flow path 8 communicates with the flow path 8*b* making a single fuel gas jetting hole group, and at the same time, the number of first combusting gas jetting holes 8*c* formed on the same circle is increased This tip nozzle as well, by merging at a point within 10 mm from the front end surface of the tip nozzle the flow path 9*c*, which branches from the flow path 9 leading to the oxygen jetting opening 9*a*, with the flow path 8*b*leading to the first fuel gas jetting hole group 8*c*, like the first embodiment, realizing an increase in the combustion efficiency. As shown in FIG. 6, the oxygen jetting opening 9*a* can be made a plurality of circular oxygen jetting hole groups centered on the tip nozzle body 1 as a whole.

Moreover, in the above-described tip nozzle, the oxygen jetting holes 7*a* and the second combustion gas jetting hole group 8*a* are formed by intermittently cutting grooves circumferentially in the sleeve 2 and the front end of the tubular body 4, but these holes can be can be a plurality of circular holes disposed so as to form a circle centered on the tip nozzle body 1 as a whole.

What is claimed is:

1. A high pressure rapid cutting tip nozzle, wherein a cutting oxygen jet hole opens on a front end surface, and with the cutting oxygen jet hole at the center, is provided concentrically from inside to outside with a first oxygen jet hole group, a first fuel gas jet hole group, a second fuel gas jet hole group, and an oxygen jet opening and by a high pressure gas flow jetting from said cutting oxygen jet hole, steel is cut; and wherein a front end of the flow path, which branches from a flow path leading to said oxygen jet opening and extends to a front end side, has openings on a side surface of the flow path leading to said first and second fuel gas jet holes at a point within 10 mm from said front end surface.

2. A high pressure rapid cutting tip nozzle, wherein a cutting oxygen jet hole opens on a front end surface and with the cutting oxygen jet hole at the center, is provided concentrically from inside to outside with a first oxygen jet hole group, a second fuel gas jet hole group, and an oxygen jet opening and by a high pressure gas flow jetting from said cutting oxygen jet hole, steel is cut; and wherein between the first oxygen jet hole group and the second fuel gas jet hole group, a first fuel gas jet hole group and an oxygen jet hole group are disposed concentrically around said cutting oxygen jet hole, and the respective holes of said first fuel gas jet hole group and said oxygen jet hole group are alternatively disposed; and a front end of the flow path branching from a flow path leading to said oxygen jet opening and extending to a front end side opens respectively on a side surface of flow paths leading to said first and second fuel gas jet holes at a point within 10 mm from said front end surface.

3. A high pressure rapid cutting tip nozzle, wherein a cutting oxygen jet hole opens on a front end surface and with the cutting oxygen jet hole at the center, is provided concentrically from inside to outside with a first oxygen jet hole group, a first fuel gas jet hole group, a second fuel gas jet hole group, and an oxygen jet opening and by a high pressure gas flow jetting from said cutting oxygen jet hole, steel is cut; and wherein a front end of the flow path branching from a flow path leading to said oxygen jet opening and extending to a front end side opens on a side surface of the flow path leading to said first fuel gas jet holes at a point within 10 mm from said front end surface, and a front end of a tubular body which partitions said second fuel gas jet hole group and oxygen jet opening is cut off at a point within 10 mm from said front end surface.

4. A high pressure rapid cutting tip nozzle, wherein a cutting oxygen jet hole opens on a front end surface, and with the cutting oxygen jet hole at the center, is provided concentrically from inside to outside with a first oxygen jet hole group, a first fuel gas jet hole group, a second fuel gas jet hole group, and an oxygen jet opening and by a high pressure gas flow jetting from said cutting oxygen jet hole, steel is cut; and wherein a front end of the flow path branching from a flow path leading to said oxygen jetting opening and extending to a front end side opens on a side surface of a flow path leading to said first fuel gas jet holes at a point within 10 mm from said front end surface.

5. A high pressure rapid cutting tip nozzle, wherein a cutting oxygen jet hole opens on a front end surface, and with the cutting oxygen jet hole at the center, is provided concentrically from inside to outside with a first oxygen jet hole group, a first fuel gas jet hole group, a second fuel gas jet hole group, and a second oxygen jet hole group disposed concentrically on said cutting oxygen jet hole and by a high pressure gas flow jetting from said cutting oxygen jet hole, steel is cut; and wherein a front end of the flow path, which branches from a flow path leading to said oxygen jet opening and extends to a front end side, has openings on a side surface of the flow path leading to said first and second fuel gas jet holes at a point within 10 mm from said front end surface.

6. A high pressure rapid cutting tip nozzle, wherein a cutting oxygen jet hole opens on a front end surface, and with the cutting oxygen jet hole at the center, is provided concentrically from inside to outside with a first oxygen jet hole group, a second fuel gas jet hole group, and a second oxygen jet group disposed concentrically on said cutting oxygen jet hole and by a high pressure gas flow jetting from said cutting oxygen jet hole, steel is cut; and wherein between the first oxygen jet hole group and the second fuel gas jet hole group, a first fuel gas jet hole group and an oxygen jet hole group are disposed concentrically around the cutting oxygen jet hole, and the respective holes of the first fuel gas jet hole group and the oxygen jet hole group are alternately disposed; and a front end of the flow path branching from a flow path leading to said oxygen jet opening and extending to a front end side opens respectively on a side surface of the flow paths leading to said first and second fuel gas jet holes at a point within 10 mm from said front end surface.

7. A high pressure rapid cutting tip nozzle, wherein a cutting oxygen jet hole opens on a front end surface, and with the cutting oxygen jet hole at the center, is provided concentrically from inside to outside with a first oxygen jet hole group, a first fuel gas jet hole group, a second fuel gas jet hole group, and a second oxygen jet hole group disposed concentrically on said cutting oxygen jet hole and by a high pressure gas flow jetting from said cutting oxygen jet hole, steel is cut; and wherein a front end of the flow path branching from a flow path leading to said oxygen jet opening and extending to a front end side opens on a side surface of a flow path leading to said first fuel gas jet holes at a point within 10 mm from said front end surface.

* * * * *

UNITED STATES PATENT AND TRADEMARK OFFICE

CERTIFICATE OF CORRECTION

PATENT NO. : 6,062,495 
DATED : May 16, 2000
INVENTOR(S) : Bunnosuke Ushioda and Tamiya Yoshino It is certified that error appears in the above-identified patent and that said Letters Patent is hereby corrected as shown below:

Title page,
Item [75], "Atami" should be -- Atami-shi --
Item [75], "Kitakyushu" should be -- Kitakyushu-shi --

Column 5,
Line 60, insert --, -- before "and"

Column 6,
Line 1, "an" should be -- said --
Line 12, insert -- , -- before "and"
Line 36, "jetting" should be -- jet --

Signed and Sealed this

Eighth Day of October, 2002

*Attest:*

*Attesting Officer*

JAMES E. ROGAN
*Director of the United States Patent and Trademark Office*